252-99 AU 166 EX
9/15/81 XR 4,289,640

United States Patent [19]

Falivene

[11] 4,289,640

[45] * Sep. 15, 1981

[54] CLEANING COMPOSITIONS

[75] Inventor: Pasquale J. Falivene, Union City, N.J.

[73] Assignee: Colgate-Palmolive Company, New York, N.Y.

[ * ] Notice: The portion of the term of this patent subsequent to Aug. 15, 1996, has been disclaimed.

[21] Appl. No.: 434,853

[22] Filed: Jan. 21, 1974

[51] Int. Cl.[3] ..... C11D 3/065; C11D 3/14; C11D 7/12; C11D 7/54

[52] U.S. Cl. ..... 252/95; 252/99; 252/140; 252/534; 252/539; 252/553; 252/558

[58] Field of Search ..... 252/99, 103, 140, 534, 252/539, DIG. 14, 95, 531, 533, 550, 552, 553, 558

[56] References Cited

U.S. PATENT DOCUMENTS

| | | | |
|---|---|---|---|
| 3,393,154 | 7/1968 | Treiter | 252/554 X |
| 3,530,071 | 9/1970 | Moore | 252/99 |
| 3,560,389 | 2/1971 | Hunting | 252/95 |
| 3,565,810 | 2/1971 | Mausner et al. | 252/DIG. 14 |
| 3,574,125 | 4/1971 | Van Paassen | 252/534 X |
| 3,715,314 | 2/1973 | Morgenstern | 252/95 |
| 3,772,204 | 11/1973 | Insignares | 252/99 |

*Primary Examiner*—Bruce H. Hess
*Attorney, Agent, or Firm*—Herbert S. Sylvester; Murray M. Grill; Norman Blumenkopf

[57] ABSTRACT

A cleaning powder having improved grease cutting and foaming characteristics contains: a particulate or powdered base material which is an abrasive or polishing agent, a detergent builder salt or a mixture thereof; a synthetic organic detergent; and an organic hydrotrope. Preferably the composition is a scouring powder and includes an abrasive and a non-phosphate builder salt, such as a carbonate, phosphate or silicate.

11 Claims, No Drawings

CLEANING COMPOSITIONS

This invention relates to cleaning compositions. More particularly, it relates to powdered or particulate cleaning compositions having improved grease cutting and foaming characteristics.

In a preferred embodiment the invention can be embodied in an abrasive scouring cleanser; it is also useful, however, in other dry powder cleaning compositions containing one or more detergents, which compositions are expected to cut grease and/or produce foam when the powder is mixed with small amounts of water. Such compositions include, for example, floor and wall cleaners, tooth powders, stainless steel and Teflon and oven and barbecue grill cleaners and chrome and tile cleaners.

Dry powder cleaning compositions, such as scouring powders and several of the other products mentioned above, have often been formulated with an inorganic builder salt in powdered form therein, to improve or build detergency. Additionally, the scouring powders usually contained a particulate or powdered abrasive or polishing agent and an organic detergent, and optionally, a bleaching agent. In prior art scouring cleanser compositions and in various other cleaning products inorganic phosphates such as pentasodium tripolyphosphate, tetrasodium pyrophosphate and trisodium phosphate and corresponding potassium salts have been used as builder salts because of their excellent detergency-improving characteristics. However, due to opinions that phosphates in cleaning compositions, especially heavy duty laundry detergents, can contribute to eutrophication of inland waters under certain circumstances, causing excessive algae growth and because of government regulations and recommendations, efforts have been made to produce non-phosphate detergents including builders other than the aforementioned phosphate salts. Although comparatively little phosphate is normally present in scouring cleansers it is also often considered desirable to eliminate it from such products, if possible. Certain classes of salts, such as alkali metal carbonates, bicarbonates, silicates, borates, etc., which have been proposed as substitutes for phosphate builders, have been found to be useful in cleaning compositions but products such as detergent powders and scouring cleansers built with them are of relatively poor foaming and grease cutting abilities when employed conventionally in aqueous media at comparatively high solids contents for cleaning and scouring effects.

The above discussed disadvantages of prior art cleansers built with non-phosphate builder salts are overcome by use of the present novel compositions which comprise: a particulate base selected from the group consisting of an abrasive or polishing agent, a detergent builder salt and mixtures thereof; a synthetic organic detergent; and an organic hydrotrope, with the proportion of hydrotrope to detergent being about 0.2 to 5, on a molar basis. With respect to scouring cleansers these include (1) up to 95%, preferably more than 50% by weight of a particulate or powdered abrasive or polishing material; (2) about 0.1 to 15% by weight of synthetic organic detergent; (3) up to 40% by weight of a builder salt; and (4) about 0.2 to 5 mols of an organic hydrotrope per mol of synthetic organic detergent. The cleaning compositions, including nonabrasive products too, comprise 0.1 to 35% of the organic detergent, 5 to 95% of abrasive and/or builder salt and 0.2 to 5 mols of hydrotrope per mol of detergent. In non-abrasive embodiments they include 0.5 to 20% synthetic detergent, 20 to 95% builder salt and 0.7 to 2.5 mols of hydrotrope per mol of detergent. Percentages given are representative, not exclusive.

It was surprising to discover that an approximately equimolar ratio of hydrotrope to organic detergent, incorporated in a particulate or powdered cleaning composition or scouring cleanser of the types described above dramatically improves the grease cutting ability thereof by as much as ten-fold when the cleaner is used for the removal of grease stains and grease films from hard surfaces, such as porcelain, enamelware, painted walls, floors, Teflon, dentures and cooking utensils, in concentrations of about 0.2 to 5 parts of cleaner per part by weight of water, as may be employed in household grease removing operations. It was also surprising to discover that the foaming abilities of the cleaners of the invention are greatly increased by the incorporation, according to the invention, of the described proportions of hydrotrope with the detergent.

Although the present invention was initially discovered while attempting to formulate an effective non-phosphate detergent composition (which is not normally as effective as phosphate containing compositions for grease cutting), it was subsequently found that, surprisingly, cleansers containing phosphates, e.g. trisodium phosphate, sodium tripolyphosphate and disodium hydrogen phosphate, can also be improved in their grease cutting and foaming properties.

Preferably the cleansing compositions of the invention contain about 60 to 95%, especially about 75 to 95% by weight of the abrasive or polishing agent, about 0.5 to 10%, especially about 1 to 5% by weight of the organic detergent; and about 1 to 25% and, especially about 2 to 10% of alkali metal carbonate or other suitable builder salt or mixture thereof.

The hydrotrope is often preferably present in a ratio of about 0.2 to 2 mols per mol of the detergent component, with especially good results being obtained when the hydrotrope is sodium cumene sulfonate and the ratio is from 1.3 to 1.7 for foaming and 0.7 to 1.5 for grease cutting, making the 0.7 to 1.7 range preferred, and 0.9 to 1.5 most preferred.

If desired, the powdered scouring cleansing composition of the invention contains about 0.1 to 25% and preferably about 0.2 to 5% by weight of an inorganic or organic bleaching agent. Because scouring cleanser bleaching agents, more particularly described hereinbelow, are water actuated and hence often are sensitive to moisture, it is preferred to incorporate an effective desiccant in the cleanser when bleach is present in order to protect the bleach from deterioration caused by ambient moisture during storage. An effective stabilizing amount of useful desiccant employed is about 0.5 to 4% of the composition or 1 to 20, preferably about 2 to 10 parts of desiccant, preferably lime (CaO), per part of bleach, preferably trichloroisocyanuric acid (TCCA) or dichlorocyanuric acid (DCCA).

As is conventional in the formulation of scouring cleansers, the composition of the invention optionally contains up to about 15%, and preferably contains about 0.01 to 10% by weight of minor adjuvants, such as perfumes, colorants, organic fillers, inorganic fillers, alkali metal halide bleach promoters, water soluble silicate alkalizers, sequestering agents, optical brighteners, antibacterial agents, flow improvers, anti-dusting agents and anti-redeposition agents, which adjuvants are more particularly described below. Generally the concentration of each such adjuvant is quite small, that is, it is in the range of about 0.001 to 5% by weight, and is frequently about 0.01 to 3% by weight of the cleansing composition.

The abrasive or polishing component of the present cleansers may be any of a large number of particulate water-soluble and insoluble substances described in the prior art as suitable. If it is desired to prepare a no-residue type of cleanser, an abrasive water soluble salt such as sodium sulfate decahydrate, calcium chloride hexahydrate, lithium potassium tartrate monohydrate, lithium fluoride, sodium chloride, potassium citrate monohydrate or other water soluble salt "abrasives", as disclosed in U.S. Pat. No. 3,577,347, of J. A. Monick, issued May 4, 1971, (incorporated herein by reference) can be employed. Usually, however, the particulate polishing agent component of the cleanser is a water insoluble, preferably siliceous material such as silica, feldspar, pumice, volcanic ash, diatomaceous earth, bentonite, or talc, or a mixture thereof. Also useful are limestone, calcite, ground nutshells, hardwood sawdust and other known insoluble abrasives and mixtures of them. For general use, it is preferred to use silica, feldspar, limestone or calcite, of various degrees of fineness, for they are relatively hard and result in a white product. Silica (as silex) and limestone provide especially good results, according to the invention.

The abrasives may vary in hardness, particle size and shape, and the choice for a particular composition is generally dependent on the contemplated field of application. The sizes of the abrasive particles are normally less than 0.5 mm., and in general, the maximum particle size of substantially all of the abrasive is under 0.15 mm. Normally the abrasive employed will have a particle size such that at least about 85% and preferably 99% by weight thereof passes through a sieve having 0.074 mm. openings. On the other hand, in the interest of effective cleansing action it is appropriate for at least about 8% by weight of the abrasive particles to have a diameter of about 0.037 mm. or larger.

The organic detergent utilized in the invention can be any suitable anionic, cationic, amphoteric or nonionic detersive material. When the detergent is a liquid under normal conditions, such as the nonionic agents generally are, it may be prepared in particulate solid form after absorption by diatomaceous earth, silex, builder salt or other similar agent in procedures known in the art. Typical organic detergents suitable for incorporation in the present scouring cleansing compositions are described in McCutcheons' *Detergents and Emulsifiers* 1969 *Annual,* wherein such compounds are listed by chemical formulas and trade names. Additional suitable organic detergents are also described in the text *Surface Active Agents and Detergents,* Vol. II, by Schwartz, Perry and Berch (Interscience Publishers, 1958).

Examples of suitable anionic detersive compounds contemplated as a preferred class of detergents within the ambit of the invention are the soaps and the sulfated and sulfonated synthetic detergents, especially those anionic detergents having about 8 to about 26 and preferably about 10 to about 22 carbon atoms to the molecule. The soaps are generally the water soluble salts of saturated higher fatty acids of 10 to 18 carbon atoms each, and mixtures thereof.

The sulfated and sulfonated detersive compounds are also known in the art and may be prepared from suitable organic materials which are applicable to sulfonation ("true" sulfonation and/or sulfation). Of the vast variety of sulfates and sulfonates suitable, it is preferred to use the aliphatic sulfates and sulfonates of about 8 to 22 carbon atoms and the alkyl aromatic sulfonates containing about 8 to about 22 carbon atoms in the alkyl group, preferably of 12 to 18 carbon atoms.

The alkyl aromatic sulfonate detergents referred to may be mononuclear or polynuclear in structure. More particularly, the aromatic nucleus may be derived from benzene, toluene, xylene, phenol, cresols, phenol ethers, naphthalene, derivatives of phenanthrene, etc. It has also been found that the alkyl group may vary similarly. Thus, for example, the alkyl groups may be of straight or branched chains (straight chains are highly preferred) and may consist of such radicals as dodecyl, tridecyl, pentadecyl, octyl, nonyl, decyl, undecyl, mixed alkyls derived from fatty materials, cracked paraffin wax olefins, and polymers of lower monoolefins, etc. While the number of sulfonic acid groups present on the mucleus may vary, it is usual to have only one such group present in order to preserve as much as possible a balance between hydrophilic and hydrophobic portions of the molecule and to obtain effective detergency.

More specific examples of suitable alkyl aromatic sulfonate detergents include the straight chain linear alkyl benzene sulfonates wherein the alkyl group contains 10 to 18 carbon atoms, e.g., averaging about 10 to 15, specific examples of which are sodium dodecyl benzene sulfonate, sodium tridecyl benzene sulfonate and sodium higher alkyl benzene sulfonate wherein the alkyl is of 10 to 15 carbon atoms, averaging about 12.5 carbon atoms per molecular proportion.

Other suitable agents are the surface-active sulfated or sulfonated aliphatic compounds, preferably of 12 to 22 carbon atoms. Within the scope of such definition are the sulfuric acid esters of polyhydric alcohols incompletely esterified with higher fatty acids, e.g., coconut oil monoglyceride monosulfate, tallow diglyceride monosulfate; the long chain pure or mixed alkyl sulfates, e.g., lauryl sulfate, cetyl sulfate; the hydroxysulfonated higher fatty acid esters, such as the higher fatty acid esters of low molecular weight alkylol sulfonic acids, e.g., fatty acid esters of isethionic acid; the fatty acid ethanolamide sulfates; the fatty acid amides of aminoalkyl sulfonic acids, e.g., the lauric acid amide of taurine; olefin and paraffin sulfonates; and the like. More particularly, it is preferred to use the sulfated aliphatic compounds containing at least about 8 carbon atoms, especially those having about 12 to about 18 or 22 carbon atoms in the molecule. In addition to or in replacement of the aliphatic and aromatic sulfate and sulfonate detergents the corresponding organic phosphate and phosphonate salts can also be used when the presence of the contained phosphorus is permissible.

Although the anionic detergents are preferred, cationic, nonionic and amphoteric detergents may be also employed in whole or as part of the detergent component, provided they are compatible with the other elements of the composition under conditions of storage and use thereof. As cationic detergents there may be used the long chain alkyl quaternary ammonium compounds, e.g., cetyl quaternary ammonium salts. Within this group are included cetyl trimethyl ammonium chloride and cetyl pyridinium chloride. Another suitable compound is diethylene aminoethyl oleyl amide.

The nonionic agents include the polyoxyethylene ethers of alkyl aromatic hydroxy compounds, e.g., the alkylated polyoxyethylene phenols, the polyoxyethylene ethers of long chain aliphatic alcohols, the polyoxyethylene ethers of hydrophobic propylene oxide polymers, and higher alkyl amine oxides, such as lauryl dimethyl amine oxide. Amphoteric detergents are also contemplated, examples thereof including the salts of higher alkyl beta-amino propionic acids, e.g., sodium N-lauryl beta-alanine; the higher alkyl substituted betaines, such as lauryl dimethylammonium acetic acid; and the imidazoline type exemplified by the disodium salt of 1-(2-hydroxyethyl)-1-(carboxymethyl)-2-(hendecyl)-4,5-dihydroimidazolinium hydroxide.

The anionic and cationic surface active agents are commonly used in the forms of their water soluble salts. For the synthetic anionic compounds, the alkali metal (e.g., sodium, potassium) salts are preferred, although other salts such as ammonium, lower alkyl amine, i.e., straight or branched chain mono-, di and trialkylamines of 1 to 4 carbons in the alkyl group, e.g., methyl amine, diisopropyl amine and tributyl amine; lower alkanolamine, e.g., ethanolamine, diethanolamine, triethanolamine and isopropanolamine; and alkaline earth and similar metal, e.g., calcium and magnesium salts; may be used, if desired. Because of their especially good flow properties when in particulate form, the sodium salts are especially preferred. For the cationic detergents, the chloride, sulfate, acetate and like anions may be present.

The builder salts in the cleaning composition of the invention are water soluble materials useful as builders for detergent components of cleaners and scouring cleansers, such as alkali metal carbonates, silicates, phosphates, bicarbonates and borates, which are available in hydrated and anhydrous forms. Suitable carbonate builders also include the alkali metal sesquicarbonates, e.g., sodium and potassium sesquicarbonates. Preferably, according to the invention, a calcined or anhydrous alkali metal carbonate is employed as the builder salt and it is preferably a sodium or potassium carbonate, especially a sodium carbonate. However, corresponding phosphates, bicarbonates, silicates and borates may be used, preferably as sodium salts, e.g., borax, sodium bicarbonate and sodium silicates of $Na_2O:SiO_2$ ratio in the range of 1:1.6 to 1:2.8, preferably 1:2.0 to 1:2.4.

The organic hydrotropes used in the invention are a well known class of solubilizing agents. Suitable hydrotropes for use in the invention are well known in the art, and include salts of aryl sulfonic acids such as naphthyl and especially, benzene sulfonic acids, wherein the aromatic nucleus may be unsubstituted or substituted with lower alkyl group(s), e.g., $C_1$ to $C_4$ alkyl group(s), preferably methyl, ethyl or isopropyl groups. Up to three such substituents may be present in the aromatic nucleus but none, one or two are preferred. The saltforming cation of the hydrotrope is preferably an alkali metal such as sodium or potassium, especially sodium. However, any of the water soluble cations exemplified above in connection with anionic detergent salts such as ammonium, mono-, di- and trilower alkyl and -lower alkanolammonium groups can be used in place of the alkali metal cations. Typical illustrative examples of suitable hydrotropes include benzene sulfonates; o-, m-, and p-toluene sulfonates; 2,3-, 2,4- and 4,6-xylene sulfonates; and cumene sulfonates, all preferably as the sodium salts. Cumene sulfonate salts (wherein the substituent on the benzene ring is an isopropyl group) give a particularly good result. An especially preferred cumene sulfonate salt hydrotrope is sodium cumene sulfonates as ortho, para, meta or mixed isomers. Other hydrotropes are lower alkyl sulfate salts having about 5 to 6 carbon atoms in the alkyl group such as alkali metal n-amyl and n-hexyl sulfates.

The bleaching agent which is optionally incorporated in the present scouring powders is any of large number of organic or inorganic compounds known to the scouring cleanser art which are inert in the dry state but, which on contact with water release oxygen, chlorine or hypohalite. Representative examples of typical oxygen-release bleaching agents, suitable for incorporation in scouring cleansers, include the alkali metal perborates, e.g., sodium perborate, and alkali metal monopersulfates, e.g., potassium monopersulfate, as disclosed in U.S. Pat. No. 3,458,446. Conventional bleaching agents capable of liberating hypohalite, e.g., hypochlorite and/or hypobromite, include heterocyclic N-bromo- and N-chloro-cyanurates such as trichloroisocyanuric and tribromoiscyanuric acid, dibromocyanuric acid, dichlorocyanuric acid, N-monobromo-N-monochlorocyanuric acid and N-monobromo-N,N-dichlorocyanuric acid, as well as the salts thereof with water solubilizing cations such as potassium and sodium, e.g., sodium N-monobromo-N-monochlorocyanurate, potassium dichlorocyanurate, sodium dichlorocyanurate, as well as other N-bromo and N-chloro- imides, such as N-brominated and N-chlorinated succinimide, malonimide, phthalimide and naphthalimide. Also useful as hypohalite-releasing bleaches are halogenated hydantoins such as 1,3-dibromo- and 1,3-dichloro-5,5-dimethyl hydantoin; N-monochloro-dimethyl hydantoin; 1,3-dibromo- and 1,3-dichloro-5-isobutyl hydantoin; 1,3-dibromo- and 1,3-dichloro-5-methyl-5-ethyl hydantoin; 1,3-dibromo- and 1,3-dichloro-5,5-diisobutyl hydantoin; 1,3-dibromo- and 1,3-dichloro-5-methyl-5-n-amyl hydantoin; N-bromo-N-chloro-5,5-dimethyl hydantoin; and N-bromo-N-chloro-5-ethyl-5-methyl hydantoin. Other suitable organic hypohalite liberating bleaching agents include halogenated melamines such as tribromomelamine and trichloromelamine, as disclosed in U.S. Pat. No. 3,577,347. Suitable inorganic hypohalite-releasing bleaching agents include lithium and calcium hypochlorites and hypobromites. The various chlorine, bromine or hypohalite liberating agents may, if desired, be provided in the form of stable, solid complexes or hydrates, such as sodium p-toluene sulfobromamine trihydrate; sodium benzene sulfochloramine dihydrate; calcium hypobromite tetrahydrate; and calcium hypochlorite tetrahydrate. Brominated and chlorinated trisodium phosphates formed by the reaction of the corresponding sodium hypohalite solution with trisodium orthophosphate (and water, as necessary) likewise comprise useful inorganic bleaching agents for incorporation into the present scouring cleansers.

Preferably, the bleaching agent used in the invention is a hypohalite liberating compound and more preferably is a hypochlorite liberating organic compound. A preferred class of hypohalite liberating organic compounds consists of dichlorocyanuric acid and trichlorocyanuric acid and the alkali metal salts thereof. Of these an especially preferred bleaching agent, trichloroisocyanuric acid, yields best results.

The desiccant preferably incorporated in the present composition to protect the cleanser from moisture, which otherwise might be adsorbed during storage, is any of a group of highly hygroscopic or chemically reactive anhydrous inorganic compounds which, when incorporated into the present bleaching compositions, preferentially sorb, take up or bind ambient moisture, for example, anhydrous trisodium phosphate, silica gels, activated aluminas, molecular sieves, alkaline earth metal oxides, such as calcium oxide, barium oxide, natural and artificial clays, such as bentonite, magnesium oxide, anhydrous magnesium sulfate and $B_2O_3$. The best desiccant used is calcium oxide, CaO. It effectively stabilizes the bleach and prevents premature release of chlorine and lachrymatory decomposition products. However, magnesium oxide or commercial unslaked lime containing calcium oxide admixed with up to about 40% by weight of magnesium oxide can also be employed very successfully.

Minor adjuvants may be added to the scouring cleanser, if desired, to achieve special functional or aesthetic effects. These adjuvants include: perfumes; organic fillers, such as sawdust and wood pulp; optical brighteners such as 7-hydroxy- or 4-methyl-7-diethylaminocoumarin; inorganic fillers, such as sodium sulfate; sequestering agents, such as nitrilotriacetic acid, ethylene diamine tetracetic acid and 2-hydroxy-ethylene-iminodiacetic acid; antibacterial agents, such as hexachlorophene; anti-caking agents, such as hydrated magnesium trisilicate; antiredeposition agents, such as sodium carboxymethyl cellulose; water soluble silicate salt alkalizers, such as sodium silicate; anti-dusting agents, such as propylene glycol; colored speckles; and flow improvers; such as silicas and clays. Other important minor adjuvants which can be incorporated into the scouring cleanser if bleach is present include bleach promoters, such as alkali metal halides, e.g., sodium bromide.

The scouring cleanser compositions of the invention can be prepared by techniques known in the art, with care usually being taken to add any water sensitive materials, such as the bleach, the desiccant, and any calcined or anhydrous builder salt after removal of water used in the incorporation in the composition of water insensitive materials such as the detergent, hydrotrope and abrasive. Conveniently, the water insensitive materials can be mixed or agitated in a conventional mixing apparatus, spray, oven, pan or drum dried according to known techniques, if moisture removal is desired, and sieved or screened prior to the admixing therewith of the particulate water sensitive compounds. The addition of the water sensitive materials to the dry or dried water insensitive components can be effected in a suitable dry mixing device such as a tumbling drum, Day mixer, Lödige mixer, Patterson Kelly V-blender or other suitable apparatus. Alternatively, all components of the present composition are, if desired, converted to the solid state according to procedures used to dry detergent solutions, and then are crushed and mixed in the dry state in a suitable mill such as a ball mill, or in a pulverizer such as a hammer mill or micropulverizer. The resultant particulate solid is then sieved or screened to remove fines and excessively coarse particles.

The described manufacturing methods are also applicable to the production of other particulate products intended to be used at relatively high concentrations in aqueous media. Floor and wall cleaners, although they may contain little or no abrasive or polishing agents, can be mixed and size reduced, as described above, or may be spray dried to larger particles, usually with over 90%, preferably over 95%, passing through a 60 mesh sieve and being retained by a 160 mesh sieve. Cleaners for Teflon, with or without polishing agent present, may be made by any of the described methods. For denture cleaners and cleansers for stainless steel and copper, very finely divided polishing agents will normally be employed and very often will be softer then the normal silex utilized, e.g., calcite, limestone or other form of calcium carbonate. In addition to being employed for toothpowders, the present compositions, with or without polishing agent and with or without builder salt (although one or both of these will be present) may be made by the described methods and may be utilized for cleaning dentures. In a variation of the invention, dental creams and other paste or gel products may be produced, containing polishing agent, detergent and hydrotrope.

The various described products, preferably in free flowing particulate form, may be used in normal manners and exhibit their best activities, with respect to cleansing and foaming, when there is present from 0.2 to 5 parts of the cleaner per part of water. However, from 0.1 to 10 parts of cleaner per part of water or other aqueous medium may also be successfully employed.

The following examples are illustrative of the invention and it will be understood that the invention is not limited thereto.

All of the solid constituents employed in the scouring cleansers and similar compositions of these examples, except speckle particles (which may be up to 2 mm. in diameter), have a maximum particle diameter of less than 0.5 mm., preferably with over 90% less than 0.074 mm. in diameter and at least 8% by weight of the abrasive (silica) particles having a diameter in the range of 0.074 to 0.15 mm. In these examples, and the specification all proportions and ratios are by weight unless otherwise specified and all temperatures are in °C.

EXAMPLE 1

| | Percent |
|---|---|
| * Silex | 84.5 |
| Perfume | 0.2 |
| Sodium bromide | 0.7 |
| Colored sodium chloride speckles | 2.0 |
| Soda ash (anhydrous sodium carbonate) | 6.0 |
| Calcium oxide | 1.0 |
| Trichloroisocyanuric acid | 0.5 |
| Sodium dodecyl benzene sulfonate (linear $C_{12}$) | 1.7 |
| ** Sodium cumene sulfonate | 1.1 |
| Sodium sulfate | 1.8 |
| Sodium silicate ($Na_2O:SiO_2$ = 1:2.4) | 0.5 |

* 85% Through No. 200 sieve (U.S. Standard Sieve Series) and all through No. 100 sieve. A pulverized quartz.
** Corresponding to about one mol of sodium cumene sulfonate per mol of sodium dodecyl benzene sulfonate.

The above ingredients are mixed in accordance with a conventional technique for preparing a particulate scouring cleansing composition containing bleach, as was previously described. The resultant product has excellent storage stability with respect to retention of the chlorine bound in the trichloroisocyanurate acid bleach even when the cleanser is stored at 80% relative humidity at 100° F. for four weeks, in standard barrier walled containers.

In testing the use of the product two parts of the cleanser are mixed with one part of water and the resultant paste or slurry is applied to six-by-six inch etched porcelain tiles, each of which is coated with 0.2 gram of beef tallow, held there for one minute, and rinsed. It is found that a major proportion of the beef tallow is removed by this treatment. When the experiment is repeated using a scouring composition identical with that above except that the sodium cumene sulfonate salt is absent, less than 10% of the beef tallow is removed from the tile. The relative foaming powers of the above scouring cleansers in water are also observed. The quantity of foam produced by the sodium cumene sulfonate-containing cleanser is greater than that produced by the cleanser which contains no hydrotrope. Similar improvements are observed when the compositions of the invention are compared to similar compositions containing much smaller proportions, such as 10% as much, of the hydrotrope.

EXAMPLE 2

The procedure of Example 1 is repeated substantially as described in preparing a particulate solid cleansing composition like that of Example 1 except that there is present in the cleanser 2.48% of sodium dodecyl benzene sulfonate and 1.5% of sodium cumene sulfonate (corresponding to about 0.95 mol of sodium cumene sulfonate per mol of sodium dodecyl benzene sulfonate). The resultant scouring cleansing composition is tested against a cleaning composition identical thereto except that it is devoid of hydrotrope. In the testing, a slurry containing 2 parts of cleanser per part of water is contacted with a beef tallow-coated tile for one minute, as described in Example 1. The results of the experiment, showing the percentage of tallow removal for each scouring cleanser, are given in the Table below.

TABLE

| Scouring Cleanser | % Tallow Removal After One Minute |
|---|---|
| Cleanser containing 2.48% detergent and 0.95 mol of hydrotrope per mol of detergent | 88 |
| Cleanser containing 2.48% detergent, no hydrotrope | 5 |

It is apparent from the above and other data obtained that by incorporating a hydrotrope in a scouring cleanser containing organic detergent, in an amount corresponding to a molar proportion of hydrotrope to detergent of about 0.9:1 or 1:1, the grease cutting ability of the cleanser is increased greatly. Foaming improvement is also noted. This is also so when the compositions of Examples 1 and 2 are used to scour sinks, clean tile floors and scour pots and clean painted woodwork at concentrations in water of 1:5, 1:2, and 2:1.

EXAMPLE 3

The procedures of Examples 1 and 2 are repeated, separately replacing the sodium linear dodecyl benzene sulfonate detergent with sodium olefin sulfonate of an average of 16 carbon atoms, sodium lauryl sulfate, sodium paraffin sulfonate of an average of 18 carbon atoms and sodium hydrogenated coconut oil fatty acids monoglyceride sulfate, separately replacing the sodium cumene sulfonate with sodium benzene sulfonate, sodium xylene sulfonate, sodium toluene sulfonate and potassium cumene sulfonate, separately replacing the silex with similarly powdered calcite, limestone, feldspar and talc, and separately replacing the sodium carbonate with potassium carbonate, sodium bicarbonate, borax and sodium silicates of $Na_2O:SiO_2$ ratios of 1:1.6; 1:2.0; 1:2.35 and 1:2.6. Additionally, the proportions of such materials are changed within the extremes of the ranges previously given, with the ranges being 0.4:1, 0.5:1, 0.7:1, 0.75:1, 0.8:1, 0.9:1, 0.95:1, 1.05:1, 1.1:1 and 2:1 for hydrotrope:detergent. In all such cases the foaming and grease cutting powers of such experimental compositions are better than those of corresponding formulas containing no hydrotrope (or no detergent) and similar formulas containing only 10% of the mentioned quantities of hydrotrope. Stabilization of the bleach constituent is also obtained with the described experimental formulas and when the calcium oxide content is varied from 0.5 to 2% or when the desiccant is replaced with others, such as anhydrous magnesium sulfate, silica gel or molecular sieves. Changes in the detergent concentration over the range of 1 to 3%, with corresponding changes in the amounts of hydrotrope employed, also result in good foaming and excellent grease cutting products. Such results are also obtained when the bleach is replaced by sodium dichlorocyanurate or other bleaches mentioned in the specification and when it is completely removed, together with the halide promoters and desiccant.

When variations in the adjuvants and proportions are made within the limits given (filler salts, such as sodium sulfate, may be increased to over 10%), similar good results are obtained. When phosphates such as sodium tripolyphosphate, trisodium phosphate, tetrasodium pyrophosphate, and $Na_2HPO_4$ are used or when NTA or EDTA sequestrants are employed as builders with or instead of the carbonate builder, improvements also result.

EXAMPLE 4

The following formulas of detersive compositions other than scouring cleaners also exhibit improved grease cutting and foaming powers, due to their contents of synthetic organic detergent and hydrotrope.

| | Percent |
|---|---|
| Wall and Floor Cleaner | |
| Sodium carbonate | 40.0 |
| Sodium silicate ($Na_2O:SiO_2$ = 1:2.0) | 40.0 |
| Sodium linear dodecyl benzene sulfonate | 5.0 |
| Sodium cumene sulfonate | 2.5 |
| Sodium sulfate, anhydrous | 10.0 |
| Moisture | 1.0 |
| Perfume, colorants, flow promoter and other adjuvants | 1.5 |
| Tooth Powder | |
| Sodium N-lauroyl sarcoside | 2.0 |
| Calcium carbonate, impalpable | 94.0 |
| Sodium toluene sulfonate | 2.5 |
| Flavoring, other adjuvants | 1.5 |
| Stainless Steel Cleanser | |
| Ground Limestone | 88.8 |
| Perfume | 0.2 |
| Sodium bromide | 0.7 |
| Spray dried detergent (55% sodium linear dodecyl benzene sulfonate, 36% sodium sulfate, 7% sodium silicate and 2% moisture) | 2.8 |
| Soda ash | 6.0 |
| Trichlorocyanuric acid | 0.5 |
| Sodium cumene sulfonate | 1.0 |

| | Percent | | | | |
|---|---|---|---|---|---|
| Component | Control | 5A | 5B | 5C | 5D |
| Sodium cumene sulfonate (96% active ingredient, about 4% sodium sulfate, in powder form) | 0 | 1.1 | 0.9 | 0.7 | 0.5 |
| Spray dried detergent beads (50% sodium linear alkyl benzene sulfonate wherein | 5.6 | 3.0 | 3.0 | 3.0 | 3.0 |

-continued

| Component | Percent | | | | |
|---|---|---|---|---|---|
| | Control | 5A | 5B | 5C | 5D |
| the alkyl is of about 10–13 carbon atoms, 36% $Na_2SO_4$, 2% moisture, 7% sodium silicate of $Na_2O:SiO_2$ ratio of about 1:2.4) | | | | | |
| Perfume | 0.2 | 0.2 | 0.2 | 0.2 | 0.2 |
| Sodium bromide | 0.7 | 0.6 | 0.6 | 0.6 | 0.6 |
| Trisodium phosphate | 3.3 | 0 | 0 | 0 | 0 |
| Soda ash | 0 | 4.0 | 4.0 | 4.0 | 4.0 |
| Lime | 0 | 2.0 | 2.0 | 2.0 | 2.0 |
| Trichlorocyanuric acid | 0.5 | 0.5 | 0.5 | 0.5 | 0.5 |
| Blue Speckles (colored sodium chloride particles) | 2.0 | 1.0 | 1.0 | 1.0 | 1.0 |
| Silex (as described in Example 1) | 87.7 | 87.6 | 87.8 | 88.0 | 88.2 |

The above compositions are made in the manner previously described.

They are tested for grease cutting and grease-removing abilities. The molar ratio of the hydrotrope to organic detergent are 0, 1.0, 0.8, 0.6 and 0.5, respectively. It is noted that the control contains no hydrotrope but is high in synthetic detergent content. In the tests run six inch by six inch etched porcelain tiles, each coated with 0.1 gram of dyed lard, uniformly spread over the surface, are employed. In each test a slurry of twenty grams of described cleanser formula in ten grams of water is mixed for thirty seconds and then allowed to remain undisturbed on the coated tile for thirty seconds after which it is gently rinsed off with water at 60° F. The percent removal of the lard is noted. For the control the average percentage removed (4 tiles were employed) is eleven whereas average percentage removals for the "experimental" formulas are 72, 83, 58 and 34, respectively. The average percentage removal when a commercial scouring cleanser is employed is 14. Thus, it is seen that the grease cutting and removal abilities of the invented compositions are much greater than for controls and successful commercial products. Similar results are obtainable when the organic detergent and hydrotrope are changed to the others previously mentioned in the specification and when the proportions are varied within the ranges given, as previously described. Best results, for grease cutting and removal, are obtained when the hydrotrope:detergent ratio is about 0.7 to 1.5 but good results are also obtained at ratios of 0.5 to 2 and acceptable grease cutting, at least with respect to improvements over controls, is obtainable in the 0.2 to 5 range, which also apply when the detergents, hydrotropes, builder salts and polishing agents are changed as taught herein, with the other materials and proportions thereof being the same or essentially the same as in the "experimental" formulas of this example. Also, such proportions apply when wall and floor cleaners of the type described in Example 4 are made. Similarly, when the soda ash is replaced in whole or in part by sodium silicate of an $Na_2O:SiO_2$ ratio of about 1:2.4, the improved grease cutting also results.

EXAMPLE 6

| | Formulas | | | | | | |
|---|---|---|---|---|---|---|---|
| | 6A | 6B | 6C | 6D | 6E | 6F | 6G |
| Silex (as in Example 1 | 84.5 | 86.5 | 87.8 | 88.5 | 89.2 | 84.5 | 86.5 |
| Perfume | 0.3 | 0.3 | 0.3 | 0.3 | 0.3 | 0.3 | 0.3 |

-continued

| | Formulas | | | | | | |
|---|---|---|---|---|---|---|---|
| | 6A | 6B | 6C | 6D | 6E | 6F | 6G |
| Sodium bromide | 0.7 | 0.7 | 0.7 | 0.7 | 0.7 | 0.7 | 0.7 |
| Soda ash | 6.0 | 6.0 | 6.0 | 6.0 | 6.0 | 6.0 | 6.0 |
| Trichlorocyanuric acid | 0.5 | 0.5 | 0.5 | 0.5 | 0.5 | 0.5 | 0.5 |
| Blue Speckles (colored sodium chloride) | 2.0 | 2.0 | 2.0 | 2.0 | 2.0 | 2.0 | 2.0 |
| Detergent (as in Example 5) | 6.0 | 4.0 | 2.7 | 0 | 0 | 4.0 | 2.7 |
| Hydrotrope (as in Example 5) | 0 | 0 | 0 | 2.0 | 1.3 | 2.0 | 1.3 |

The compositions are made in the manner described in Example 5 and in the other examples to which Example 5 relates. After manufacture the foaming abilities of each of the products are measured by adding 20 grams of distilled water at room temperature to a 250 ml. graduated cylinder, followed by 20 grams of a cleanser (to make a 1:1 slurry). The cylinder is vigorously shaken 20 times and is placed on a table. After five minutes, the foam height is measured from the liquid/foam interface to the top of the foam. The experiments are repeated using 20 grams of cleanser with 40 grams of distilled water (1:2 slurry). Foam heights are recorded below.

| Experiment | 6A | 6B | 6C | 6D | 6E | 6F | 6G |
|---|---|---|---|---|---|---|---|
| Foam Height (20 g. Cleanser / 20 g. Water) | 11 | 10 | 10 | 7 | 3 | 105 | 92 |
| Foam Height (2 g. Cleanser / 40 g. Water) | 60 | 45 | 45 | 7 | 5 | 260 | 190 |

From the above results it is apparent that the scouring cleansers containing synthetic organic detergent and organic hydrotrope are better foaming than those containing either the detergent or hydrotrope alone, even when the total of the organic materials is the same.

In other experiments in which the proportions of detergent and hydrotrope are varied, with the total of the detergent composition (55% sodium linear alkyl benzene sulfonate active ingredient detergent) and the hydrotrope (sodium cumene sulfonate) being 4% in one case and 6% in another case, it is determined that the maximum foam height is obtained at about a molar ratio of sodium cumene sulfonate to linear alkyl benzene sulfonate of about 1.3 to 1.7, e.g., about 1.5. A preferred range of such ratios is from 1 to 2 with less preferred but still useful ranges being from 0.2 to 2 and 0.2 to 5. Thus, a preferred range for both grease cutting and foaming for the products of this invention is from 0.5 to 2, most preferably from 0.9 to 1.5.

Of course, variations made in the above formulas by substitution of other detergents, hydrotropes, builder salts, polishing agents and bleaches, e.g., sodium dichlorocyanurate, also result in improved cleansers, having better foaming and grease cutting properties than controls of the types mentioned.

The invention has been described with respect to examples and illustrations thereof but is not to be limited to these because it is evident that one of ordinary skill in the art to which the invention pertains will be able to utilize substitutes and equivalents without departing from the spirit of the invention or the scope of the claims.

What is claimed is:

1. A dry powder cleaning composition comprising a particulate base selected from the group consisting of an abrasive and a detergent builder salt and mixtures thereof; a synthetic organic detergent; and an organic hydrotrope, with the proportion of hydrotrope to detergent being in the range of about 0.4 to 5, on a molar basis, at least about 8% by weight of any such abrasive particles having a diameter of at least about 0.037 mm.

2. A cleaning composition according to claim 1 which is a souring powder comprising:

(1) up to 95% of a powdered abrasive material;

(2) about 0.1 to 15% of an organic detergent; and (3) up to 40% of a builder salt.

3. A composition according to claim 2 wherein the abrasive material is a water insoluble siliceous abrasive present in a proportion of about 60 to 95%, the organic detergent is an anionic detergent, the builder salt is an alkali metal builder salt selected from the group consisting of alkali metal phosphates, carbonates, silicates and mixtures thereof and is present in a proportion of about 1 to 25%, the organic hydrotrope is a water soluble salt of an aryl sulfonic acid containing 0 to 3 lower alkyl substituents in the aryl nucleus thereof, and the ratio of hydrotrope to organic detergent, on a molar basis, is in the range of 0.4 to 2.

4. A composition according to claim 3 wherein the particles thereof, except for some or all of a speckling material which may be present, have an average particle size less than about 0.5 mm., the siliceous abrasive is present in a proportion of about 75 to 95%, the anionic detergent is selected from the group consisting of aliphatic sulfate and sulfonate salts of about 8 to 22 carbon atoms and alkyl aryl sulfonate salts containing about 8 to 22 carbon atoms in the alkyl substituent, the hydrotrope is a benzene sulfonic acid salt containing 0, 1 or 2 lower alkyl substituents on the benzene nucleus and there is present about 0.2 to 5% of a bleaching agent.

5. A composition according to claim 4 wherein the particle size of the siliceous abrasive is less than about 0.15 mm., the anionic detergent is a linear alkyl benzene sulfonate salt present in a proportion of about 0.5 to 10%, the bleaching agent is a hypohalite-liberating compound or mixture of compounds and there is present about 1 to 20 parts of desiccant per part of bleaching agent.

6. A composition according to claim 5 wherein the detergent is a linear alkyl benzene sulfonate salt present in a proportion of 1 to 5%, the builder salt is sodium carbonate present in a proportion of about 2 to 10%, the hydrotrope is present in a proportion of about 0.5 to 2 mols per mol of detergent, the bleaching agent is a hypochlorite-liberating organic compound present in a concentration of about 0.1 to 25% and the desiccant is present in a proportion of about 2 to 10 parts per part of bleach.

7. A composition according to claim 6 wherein the bleaching agent is selected from dichlorocyanuric acid and alkali metal salts thereof and trichlorocyanuric acid and alkali metal salts thereof and from 0.2 to 5% thereof is present and there is present up to about 15% of adjuvant materials selected from the group consisting of perfumes, colorants, organic fillers, inorganic fillers, alkali metal halides, bleach promoters, water soluble silicates, alkalizers, optical brighteners, antibacterial agents, sequestering agents, anti-dusting agents, anti-caking agents, anti-redeposition agents and mixtures thereof.

8. A composition according to claim 7 wherein the abrasive polishing agent is silica and the anionic detergent and hydrotrope are present as alkali metal salts.

9. A composition according to claim 8 wherein the detergent is sodium linear dodecyl benzene sulfonate and the hydrotrope is sodium cumene sulfonate.

10. A composition according to claim 9 wherein the bleach is trichloroisocyanuric acid and the desiccant is calcium oxide.

11. A method for removing greasy materials from a surface consisting essentially of the step of cleansing said surface with a dry powder cleansing composition having therein a detergent and a hydrotrope, the proportion of hydrotrope to detergent being from 0.4 to 5 on a molar basis.

* * * * *